US005656980A

United States Patent [19]

Zimmerman

[11] Patent Number: 5,656,980

[45] Date of Patent: Aug. 12, 1997

[54] MULTIPLE OUTPUT RF FILTER AND WAVEGUIDE

[75] Inventor: Eric J. Zimmerman, San Jose, Calif.

[73] Assignee: Harris Corporation, Melbourne, Fla.

[21] Appl. No.: 598,404

[22] Filed: Feb. 8, 1996

Related U.S. Application Data

[63] Continuation of Ser. No. 310,778, Sep. 27, 1994, abandoned

[51] Int. Cl.[6] ..... H01P 1/208

[52] U.S. Cl. ..... 333/208; 333/135; 333/212

[58] Field of Search ..... 333/212, 206, 333/207, 208, 204, 209, 227, 228, 230, 231, 246, 126, 128, 134, 135, 137, 123, 248

[56] References Cited

U.S. PATENT DOCUMENTS

| | | | |
|---|---|---|---|
| 2,512,191 | 6/1950 | Wolf . | |
| 2,519,734 | 8/1950 | Bethe . | |
| 2,976,499 | 3/1961 | Sferrazza . | |
| 3,114,888 | 12/1963 | Wilson . | |
| 3,721,921 | 3/1973 | Lamy et al. | 333/10 |
| 4,091,343 | 5/1978 | Knox et al. | 333/10 |
| 4,602,229 | 7/1986 | Yester, Jr. et al. | 333/208 |
| 4,792,771 | 12/1988 | Siu | 333/208 |
| 4,801,903 | 1/1989 | Mohr | 333/113 |
| 4,928,077 | 5/1990 | Devaux et al. | 333/111 |
| 4,983,933 | 1/1991 | Yolk et al. | 333/109 |
| 5,012,211 | 4/1991 | Young et al. | 333/212 |
| 5,107,231 | 4/1992 | Knox | 333/109 |
| 5,291,158 | 3/1994 | Blair et al. | 333/126 |

FOREIGN PATENT DOCUMENTS

| | | |
|---|---|---|
| 210384 | 7/1956 | Australia . |

*Primary Examiner*—Benny Lee
*Assistant Examiner*—David Wu
*Attorney, Agent, or Firm*—Rogers & Killeen

[57] ABSTRACT

A multiple output filter coupler for providing plural RF output signals from a single RF input signal may include an RF waveguide filter for receiving an RF input signal at one end thereof and for filtering the received RF input signal along its length, and plural connectors attached to the waveguide filter's end cavity for providing plural filtered RF output signals. Tuners attached to the waveguide filter proximate the connectors may be used to vary the relative signal strengths of the filtered RF output signals. The filter coupler's output and input may be interchanged to provide a single output from multiple inputs.

14 Claims, 2 Drawing Sheets

MULTIPLE OUTPUT RF FILTER AND WAVEGUIDE

This is a continuation of application Ser. No. 08/310,778, filed Sep. 27, 1994, now abandoned.

BACKGROUND OF THE INVENTION

The present invention relates to methods and devices for coupling an antenna to plural receivers, and more particularly to a method and device for providing two filtered radio frequency (RF) output signals of selectable signal strength to two radio receivers from a single RF input signal received on an antenna.

An RF input signal received on an antenna may be provided to a waveguide for transmission to a location where suitable connections to radio receivers can be made, typically with an antenna coupling unit (ACU). An ACU directs transmit and receive signals to and from an antenna, and typically includes microwave circulators and/or isolators, filters, a splitter (hybrid or coupler), and a switch. When an antenna feeds multiple receivers that are to be protected (redundant), the ACU splits the RF input signal and provides output signals to the receivers. The split may be equal (0 dB difference between the output signals) or unequal (for example, one output signal may be 7 dB less than the other).

However, the ACU causes an insertion loss that decreases the signal to noise ratio, thereby lowering system gain. The loss is especially noticeable in systems in which the ACU splits the output signals unequally, and it is an object of the present invention to significantly reduce insertion loss caused by the ACU, especially when compared to ACUs in which a separate splitter follows the filter. Several solutions to this problem have been attempted, but none has proven satisfactory. For example, some early ACUs were comprised principally of a waveguide with reasonably low loss, but these were large and costly. The splitter was a 3 dB hybrid that split the input into two equal strength signals that fed two receivers. The insertion loss of the hybrid splitter was high, on the order of 3 db for the split and 0.3 dB residual for the waveguide at 6 GHz (in addition to the filter loss). A compromise was to reduce the loss in one of the split signals at the expense of the other signal. The hybrid was replaced with a 1 and 7 dB coupler that had a 1.2 dB insertion loss for the main receiver and 7 dB insertion loss for the secondary receiver at 6 GHz (in addition to filter loss). This provided about a 2 dB improvement at one receiver, but the higher loss at the other receiver was not acceptable to many users. Consequently, users who wanted to have the ability to select whether a signal was to be equally split or whether it was to be provided with low loss to one receiver were forced to employ both a hybrid and a coupler.

In other systems in which small size was more important than insertion loss, the size of the ACU was reduced by using thin film technology for power splitting even though insertion loss actually increased. This was done by attaching a waveguide-to-coax transducer to the waveguide filter's output flange. A coax cable was installed between the transducer's output connector and the thin film splitter (hybrid or coupler). Costs were reduced by integrating the transducer into the end of the filter (beyond the filter's end cavity) by removing the waveguide flange. Length was shortened by the moving the transducer's coax SMA connector from outside the waveguide filter's end cavity and directly coupling the SMA to the filter's end cavity. A small reduction in insertion loss could be achieved by connecting the splitter directly to the waveguide filter's output SMA connector, eliminating the loss in the connecting cable. Thus, prior art systems either reduced insertion loss, but were large and costly, or were small, but increased insertion loss.

It is desirable to improve the capability of a device connecting the antenna to the radio receivers by providing a selectable split between the signal strengths of the output signals so that the device can be used in systems with an equal split, a predetermined split, or a variable split. It is further desirable to add the ability to filter an input signal in the waveguide.

Accordingly, it is an object of the present invention to provide a novel device and method for providing two output RF signals from a single input RF signal that obviates the problems of the prior art.

It is a further object of the present invention to provide a novel device and method for providing two output RF signals from a single input RF signal without a separate power splitter and the insertion loss attendant therewith.

It is yet a further object of the present invention to provide a novel device and method for providing two output RF signals from a single input RF signal in which connectors for the output signals are attached directly to the waveguide, thereby eliminating the splitter (hybrid or coupler).

It is still a further object of the present invention to provide a novel waveguide that filters an input signal and provides two filtered output signals of selectable signal strength.

It is another object of the present invention to provide a novel multiple output filter coupler and method for providing plural RF output signals from a single RF input signal, the coupler having an RF waveguide filter for receiving an RF input signal at one end and plural tunable connectors attached at its end cavity for providing plural filtered RF output signals.

It is yet another object of the present invention to provide a novel integrated filter coupler and method for providing two radio frequency (RF) output signals of selectable signal strength from a single RF input signal with a waveguide that has two tuning adjusters inserted into an end plate closing one end of the waveguide for selectably varying the signal strength of one RF output signal relative to the signal strength of the other RF output signal.

It is still another object of the present invention to provide a novel filter coupler in which the length of the filter is reduced by putting coax connectors in the waveguide filter's end cavity rather than using a coax-to-waveguide transition at the end of the end cavity.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
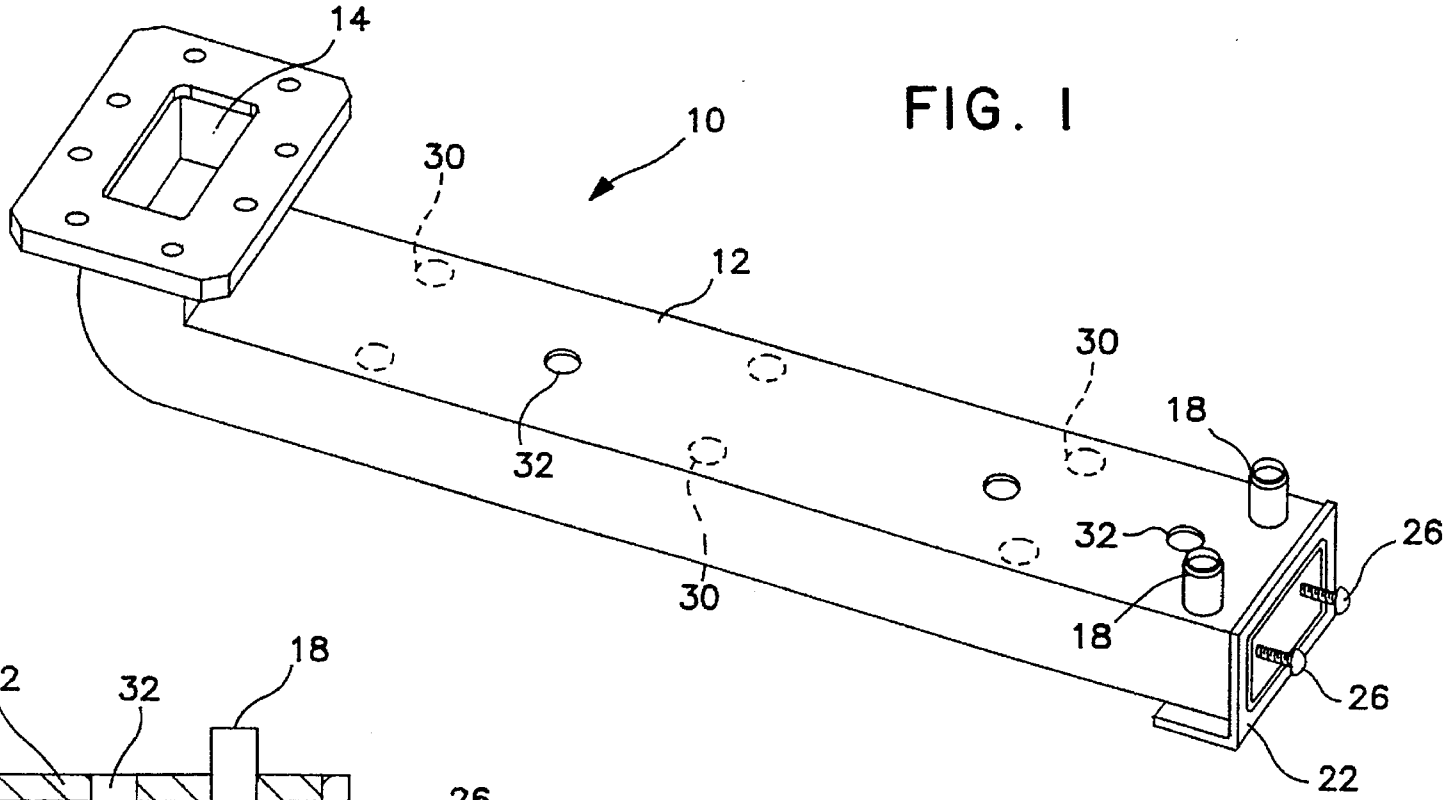
FIG. 1 is a pictorial depiction of an embodiment of the present invention.
Figure 2:
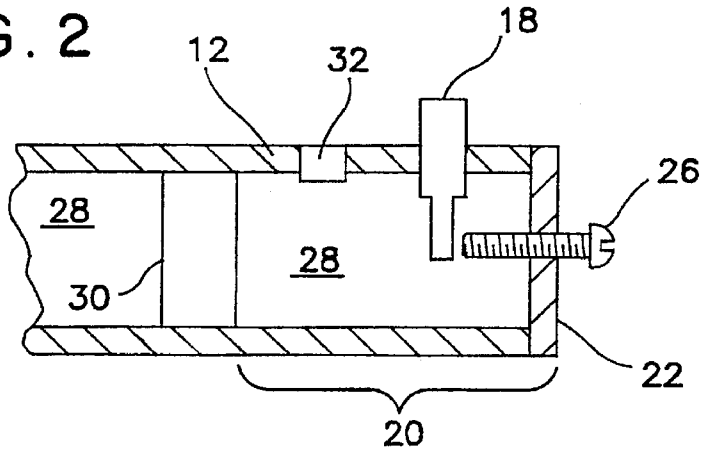
FIG. 2 is a vertical cross section of an end of an embodiment of the waveguide of the present invention illustrating an exemplary relationship of the connectors to the tuning adjusters.

With reference now to FIGS. 1 and 2, an embodiment of the multiple port filter coupler 10 of the present invention may include a waveguide 12 having an opening 14 at one end for receiving an RF input signal, plural connectors 18 in an end cavity 20 of the waveguide 12 for providing RF output signals to the receivers connected thereto, an end plate 22 for closing the end cavity 20 of the waveguide 12, and tuning adjusters 26, one associated with each of the connectors 18, for tuning the RF output signal of the associated connector 18 and for selectably varying the signal strength of the RF output signal at one connector 18 relative to the signal strength of the RF output signal at the other connector 18. The waveguide 12 may include plural compartments 28 separated by posts (or vanes) 30 interior to the waveguide, the compartments 28 being tunable to particular frequency ranges with devices placed in apertures 32 in the waveguide for tuning the filter to a particular frequency range.

In operation, an input signal is received in opening 14 of the waveguide 12 and filtered as it moves through the waveguide. At end cavity 20, the filtered signal is conveyed to connectors 18 that each provide an output signal for a suitable RF receiver connected thereto. Significantly, the conventional coaxial coupler/splitter and attendant insertion loss, have been eliminated from the signal path. The coupler 10 may operate with any appropriate frequencies, including microwave frequencies (for example, at 18 and 23 GHz).

The characteristics (for example, impedance and signal strength) of an output signal from a connector 18 may be varied by varying the distance between the connector 18 and its associated tuning adjuster 26. For example, the signal strength of one output signal may be adjusted so that it is the same as the other output signal, a predetermined amount less (such as 7 dB), or an amount that may be variably selected by adjusting the distance the tuning adjuster is inserted into the waveguide. Larger variability may be achieved by adjusting the depth the connector 18 is inserted into the end cavity 20.

The waveguide 12 may take any appropriate size and shape, with the embodiment of FIG. 1 being illustrative. The connectors 18 may be conventional cable connections, such as SMA connectors, and may be placed through a wall of the waveguide 12 into an end cavity 20 or other appropriate location where the signal may be received. The tuning adjusters 26 may be appropriate devices, such as screws, and may be inserted through the end plate 22 as shown, or through a wall of the waveguide 12.

Figure 3:
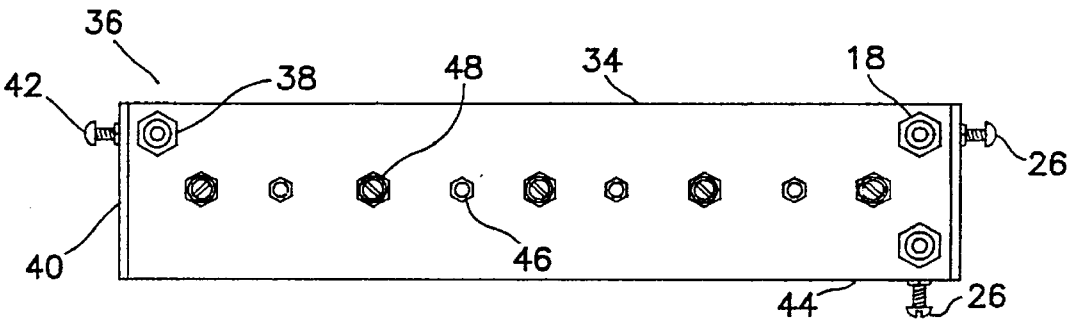
FIG. 3 is an overhead view of a further embodiment of the present invention.
Figure 4:
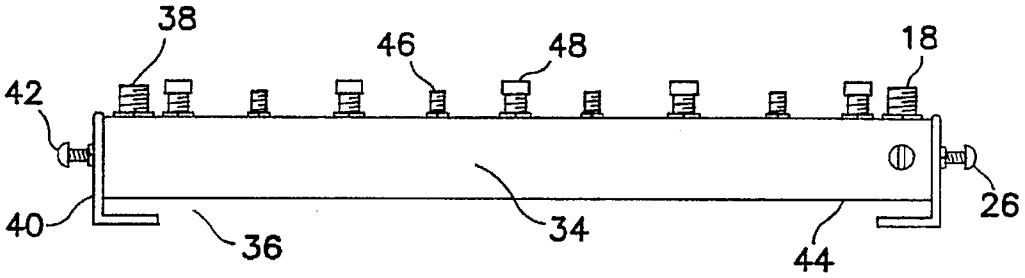
FIG. 4 is a side view of the embodiment of FIG. 3.

With reference now to FIGS. 3 and 4, in an alternative embodiment waveguide 34 may include an end 36 with means for receiving an input signal from a cable, and to this end, the end 36 may include a connector 38, end plate 40 and tuner 42 extending into an end cavity of the waveguide 34. The other end 44 of the waveguide 34 may include the multiple connectors described above. The cavities in the waveguide may be tuned with conventional tuning devices 46 and 48.

Figure 5:
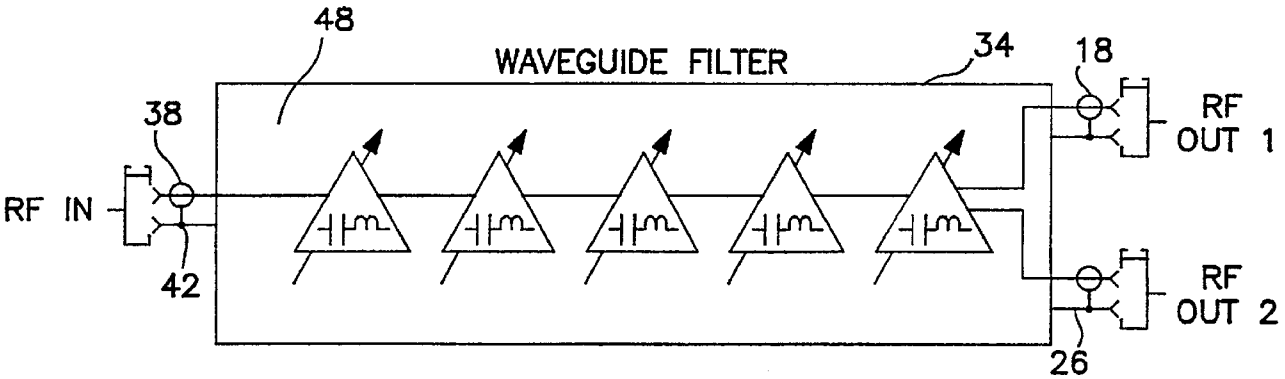
FIG. 5 is a circuit diagram of the embodiment of FIG. 3.

A circuit diagram for the embodiment of FIGS. 3 and 4 is shown in FIG. 5, in which the same element numbers have been used in the interest of clarity. The device may operate at microwave frequencies with up to about 4.0 dB insertion loss for each RF output when the signal strengths are equal, or up to about 2 dB and 9 dB insertion loss when the signal strengths are split with a 7 dB differential. Almost all of the insertion loss is from the filter, the loss associated with the splitter having been significantly reduced.

As will be appreciated, the RF input and output may be interchanged so that the filter coupler 34 may be used as a multiple input/single output device.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. An integrated filter coupler for connecting two radio frequency (RF) signals to a single RF signal, the two RF signals being copies of the single RF signal, comprising:

a hollow waveguide having first and second ends;

a first coupler connector at said first end of said waveguide for the single RF signal;

a first tuner inserted into said waveguide first end a selectable distance for tuning the single RF signal at said first connector;

second coupler connectors with extensions inserted into said waveguide at said second end which is free of partitions between said extensions of said second connectors into said second end, each of said connectors for providing one of the two RF signals which are copies of the single RF signal; and second tuners inserted into said waveguide second end a selectable distance, each of said second tuners for tuning the RF signal at one of said second connectors, and for selectably varying the signal strength of the RF signal at one said second connector relative to the signal strength of the RF signal at the other said second connector.

2. The coupler of claim 1 wherein said first and second ends of said waveguide are closed with first and second end plates.

3. The coupler of claim 2 wherein said first tuner is extend through said first end plate, and at least one of said second tuners is extended through said second end plate.

4. The coupler of claim 1 wherein said first and second ends of said waveguide comprise respective end cavities separated from the remainder of said hollow waveguide interior with posts extending laterally therethrough.

5. The coupler of claim 1 wherein said waveguide further comprises plural tunable cavities for filtering the RF input signal.

6. The coupler of claim 1 wherein said waveguide has an interior with a generally rectangular vertical cross section of a size suitable for operation with radio frequencies of at least a gigahertz.

7. The coupler of claim 1 wherein said first and second connectors are SMA connectors.

8. A method of providing two filtered radio frequency (RF) output signals of selectable signal strength which are filtered copies of a single RF input signal received on an antenna, comprising the steps of:

providing the RF input signal from the antenna to a hollow waveguide filter at an opening at a first end thereof;

filtering the RF input signal with plural tunable cavities interior to the waveguide filter;

providing each of the two filtered RF output signals from a different one of two output connectors inserted into an end cavity of the waveguide filter perpendicular to an axis of the waveguide filter at a second end thereof which is free of partitions between the inserted connectors, each connector providing an RF output signal which is a filtered copy of the RF input signal to one of the radio receivers; and selectably varying the signal strength of the filtered RF output signals with two tuning adjusters inserted into the second end of the waveguide filter perpendicular to a corresponding one of the output connectors, each of the tuning adjusters being positioned at a selectable distance into the waveguide filter into proximity with the corresponding one of the output connectors, whereby the signal strength of one RF output signal for one radio receiver may be varied relative to the signal strength of the other RF output signal for the other radio receiver.

9. A multiple output filter coupler for providing plural filtered RF output signals of selectable relative signal strengths from a single RF input signal, said filter coupler comprising:

a RF waveguide filter for receiving an RF input signal at one end thereof and for filtering the received RF input signal along its length;

plural connectors, each for providing one of the plural filtered RF output signals and each with an extension extending into a second end of said waveguide filter perpendicular to an axis of said waveguide filter at the second end, said second end being free of partitions between said extensions of said plural connectors so that the filtered RF output signals have the same frequencies; and plural signal strength adjusters, each for being inserted into said second end perpendicular to, and at a selectable distance from, a different one of said extensions to selectively vary the relative signal strengths of the filtered RF output signals from said connectors.

10. The filter coupler of claim 9 wherein at least one of said plural signal strength adjusters is inserted through a wall of said waveguide filter.

11. The filter coupler of claim 9 wherein at least one of said plural signal strength adjusters is inserted through an end plate closing said second end.

12. The filter coupler of claim 9 wherein said waveguide filter comprises plural compartments along its length, each of said compartments having a device therein for tuning a frequency response of said waveguide filter.

13. The filter coupler of claim 12 wherein said tunable compartments are tuned by devices inserted into said tunable compartments a selectable distance through apertures in sides of said waveguide filter.

14. The filter coupler of claim 9 wherein the RF input signal is a microwave signal.

* * * * *